United States Patent [19]

Sugimoto

[11] 4,173,132

[45] Nov. 6, 1979

[54] DYEING APPARATUS

[75] Inventor: Isao Sugimoto, Aichi, Japan

[73] Assignees: Yoshida Kogyo Kabushiki Kaisha, Chiyoda; Nippon Dyeing Machine Mfg. Co., Ltd., Aichi, both of Japan

[21] Appl. No.: 909,123

[22] Filed: May 24, 1978

[51] Int. Cl.[2] ..... D06B 5/18

[52] U.S. Cl. ..... 68/189

[58] Field of Search ..... 68/150, 189, 198

[56] References Cited

U.S. PATENT DOCUMENTS

| | | | |
|---|---|---|---|
| 1,280,188 | 10/1918 | Dudley | 68/150 |
| 2,707,383 | 5/1955 | Newcomb et al. | 68/189 |
| 3,318,121 | 5/1967 | Fry | 68/189 |
| 3,685,324 | 8/1972 | Vorderbruegge et al. | 68/150 |

FOREIGN PATENT DOCUMENTS

| | | | |
|---|---|---|---|
| 2525871 | 12/1976 | Fed. Rep. of Germany | 68/189 |
| 2258902 | 8/1975 | France | 68/189 |

*Primary Examiner*—Philip R. Coe

*Attorney, Agent, or Firm*—Bucknam and Archer

[57] ABSTRACT

A dyeing apparatus is disclosed, which comprises a vessel and a perforated cylinder or beam concentrical thereto, the cylinder having a material wound thereon which is to be dyed. A confining non-perforated cylinder is interposed concentrically between the vessel and the beam and provided with a longitudinal opening through which dye liquid, after passing through the layer of the material, is allowed to overflow to the bottom of the vessel.

6 Claims, 4 Drawing Figures

DYEING APPARATUS

BACKGROUND OF THE INVENTION

1. Field of the Invention

This invention relates to improvements in and relating to a dyeing apparatus, more particularly to such an apparatus which is equipped with a perforated cylinder or beam around which a material to be dyed is wound.

2. Prior Art

Conventional byeing apparatus of the type described generally comprise a dyeing vessel connected to a dye circulating system including a motor, a pump, conduit piping and a heat-exchanger, the arrangement being that dye liquid is supplied to and withdrawn from the vessel and circulated back to the vessel, in which instance the vessel is required to be filled up so as to ensure complete soaking of the material within the vessel. With such conventional apparatus, increased amounts of dye liquid have been required to carry out the beam dyeing operation; usually about from 1:15 to 1:25 bath ratios of material to dye liquid being used. Consequently, it has been necessary to increase the size or capacity of the motors, pumps, heat-exchangers and other equipment associated with the dyeing vessel or required to treat waste liquid.

SUMMARY OF THE INVENTION

Whereas, the present invention seeks to provide an improved beam-dyeing apparatus having certain structural features which will eliminate the aforementioned drawbacks of the prior art.

A more specific object of the invention is to provide an improved beam-dyeing apparatus which can accomplish the dyeing operation efficiently and completely with reduced equipment capacity and hence, minimum consumption of power and dye liquid (dye-stuff and assistants).

According to the invention, there is provided a dyeing apparatus comprising: a vessel having a substantially circular cross-section; a perforated cylinder or beam mounted concentrically within said vessel and adapted to wind thereon a material to be dyed; a confining non-perforated cylinder interposed concentrically between said vessel and said beam and provided at its upper portion with a longitudinal extending opening for permitting an overflow of dye liquid; and means circulating a dye liquid through said vessel.

The above and other objects and features of the invention will be better understood from reading the following detailed description taken with reference to the accompanying drawings which illustrate by way of example a preferred embodiment which the invention may assume in practice.

BRIEF DESCRIPTION OF THE DRAWINGS

In the drawings in which like reference characters refer to like and corresponding parts throughout the several views.

DESCRIPTION OF THE PREFERRED EMBODIMENT

Figure 1:
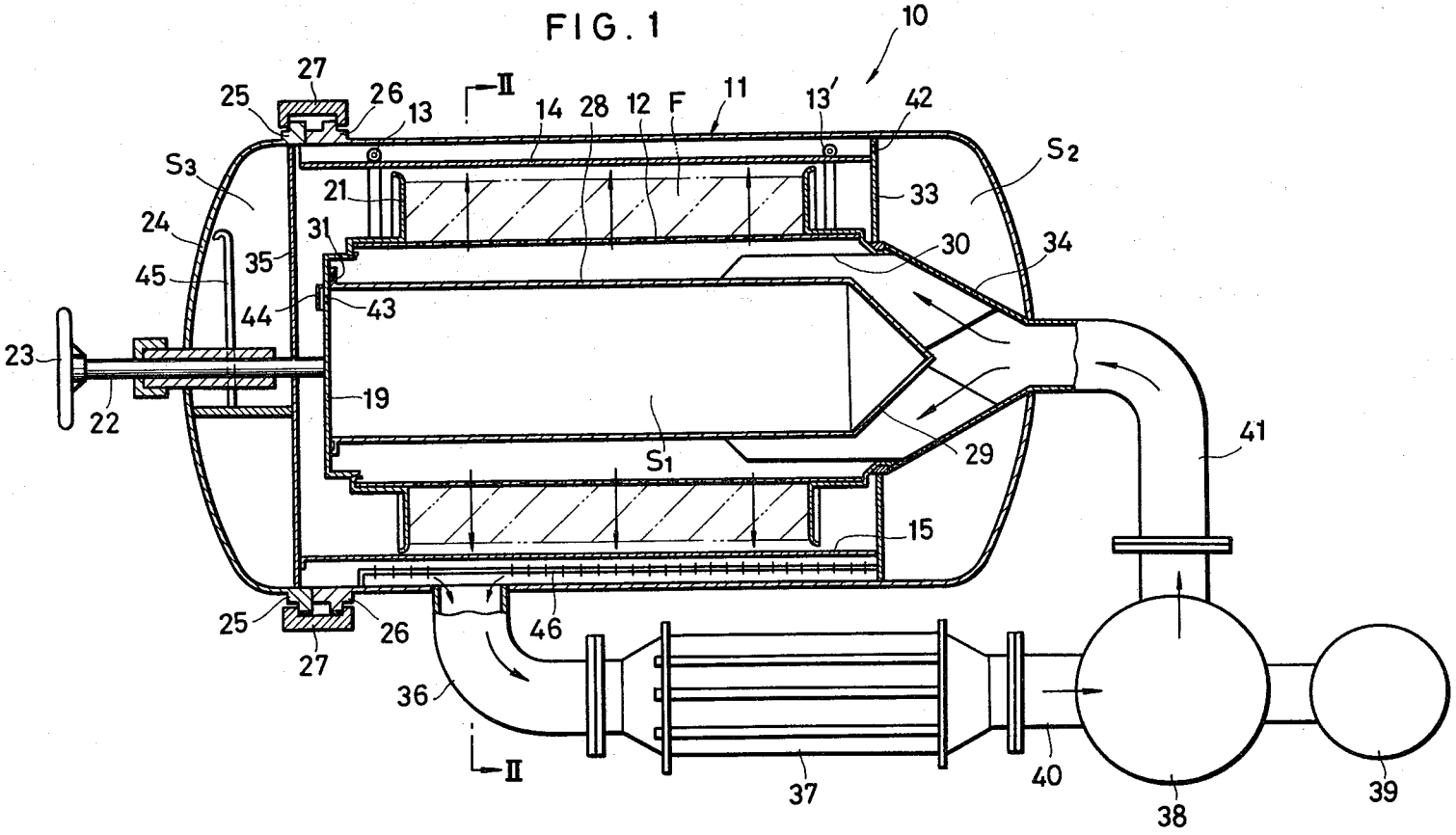
FIG. 1 is a longitudinal cross-sectional, partly schematic, view of a beam dyeing apparatus provided in accordance with the invention.

Referring now to the drawings and FIG. 1 in particular, there is shown a beam-dyeing apparatus of the invention generally designated at 10, which apparatus comprises a horizontally mounted vessel 11 which is generally circular in its cross section. A perforated cylinder 12, commonly known as a beam, is mounted concentrically within the vessel 11. The beam 12 has a pair of rollers 13, 13' at its opposite ends which are movably mounted on a rail 14 secured to and extending longitudinally of the vessel 11.

An intermediate confining, non-perforated cylinder 15 is interposed concentrically between the inner wall of the vessel 11 and the outer wall of the beam 12. The intermediate confining cylinder 15 is provided at its upper portion adjacent to the rail 14 with a longitudinally extending opening 16 for purposes hereafter to be described.

Figure 2:
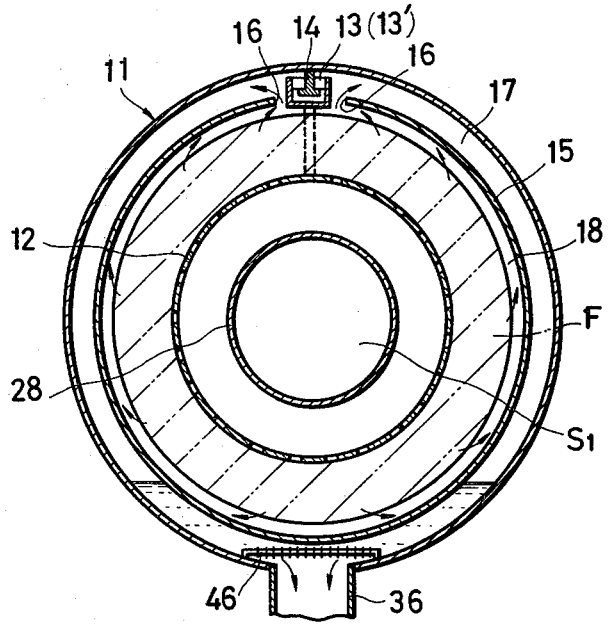
FIG. 2 is a transverse cross-sectional view taken on the line II—II of FIG. 1.

As better shown in FIG. 2, there are formed at first circumferential chamber 17, hereinafter referred to as a circulation chamber, between the inner wall of the vessel 11 and the outer wall of the confining cylinder 15, and a second circumferential chamber 18, hereinafter referred to as a treatment chamber, between the inner wall of the confining cylinder 15 and the outer wall of the beam 12.

Referring back to FIG. 1, the front end of the beam 12, upon being inserted into the vessel 11, is closed by a lid 19 which has a bevelled portion 20 (FIG. 3) engageable with a bracket member 21. A plurality of these bracket members 21 are provided adjacent each end of the beam 12 to confine and hold the fabric F wound around the beam 12 which is to be dyed.

The lid 19 is centrally engageable with a rod 22 connected to a handle 23. Rotating this handle in one direction clamps the lid 19 to seal the front end of the beam 12 and in the opposite direction releases the lid 19 to permit removal of the beam 12 when a cycle of dyeing operation has been completed. The lid 19 is covered by a removable cap 24 which is threadedly engaged with the handle rod 22 and which has a rim 25 disposed for sealed engagement with a similar rim 26 formed on the vessel 11. The two rims 25, 26 are clamped together by a clamping ring 27.

Figure 3:
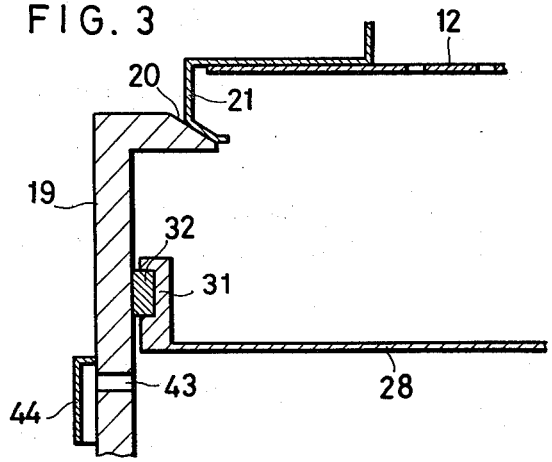
FIG. 3 is a sectional view of a portion of the apparatus shown in FIG. 1.

A dummy non-perforated cylinder 28 is mounted concentrically within the perforated cylinder or beam 12, and has a conically shaped, closed rear end 29 which is supported in place by arms 30 extending suitably from a rigid frame member not shown. The open front end of the dummy cylinder 28 is closed by the lid 19, as a recessed rim 31 formed on the cylinder 28 is fitted with a projection 32 on the lid 19, as shown in FIG. 3. The dummy cylinder 28 is provided primarily for the purpose of minimizing idle space $S_1$ within the beam 12 and hence economizing the use of operating dye liquid. To achieve the same purpose, a partition member 33 is provided to isolate idle space $S_2$ at the rear end portion of the vessel 11 from the liquid circulating areas of the vessel, the member 33 extending from the wall of the vessel 11 and tieing into the peripheral edge of a flared connector 34, later described, as shown in FIGS. 1 and 4.

Another partition member 35 is provided to isolate idle space $S_3$ defined by the cap 24 from the liquid circulating areas of the vessel 11, the member 35 being secured circumferentially to the rim 25 of the cap 24.

A withdrawal conduit 36 is connected at one of its ends to the bottom of the vessel 11 adjacent to the front end thereof and at the other end to a heat exchanger 37 adapted to maintain the dye liquid at a predetermined temperature. A pump 38 driven by a motor 39 is connected at is suction side to the heat exchanger 37 via conduit 40 and at its discharge side to a flared connector 34 via conduit 41, the flared connector 34 having its flared end substantially coextensive in diameter with the beam 12 to effect uniform distribution of dye liquid through the treatment chamber 18.

Figure 4:
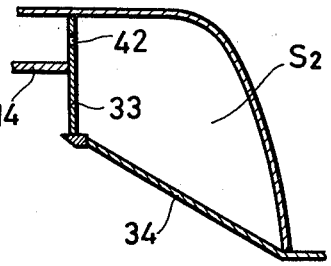
FIG. 4 is a sectional view of another portion of the apparatus of FIG. 1.

A vent hole 42 is formed in the upper portion of the partition member 33 adjacent to the rail 14, as better shown in FIG. 4, the hole 42 being adapted to equalize the pressure in idle space $S_2$ with the pressure in the liquid circulating regions of the vessel 11, thereby permitting of the use of reduced width material for the partition 33.

For the same reason, there is provided a similar vent hole 43 in the lid 19 adjacent to the upper portion of the dummy cylinder 28 to equalize the pressure in idle space $S_1$ with the liquid resident pressure. A blind member 44 is provided to mask the hole 43 and thereby to prevent entry of the dye liquid into the dummy cylinder 28. There is also for the same reason provided a vent pipe 45 which is adapted to equalize the pressure in idle space $S_3$ with the liquid resident pressure.

In operation of the dyeing apparatus 10 of the invention, the dye liquid is supplied by the pump 38 through the discharge conduit 41 and through the flared connector 34 whereupon the liquid is distributed uniformly through the treatment chamber 18. The liquid is forced radially outwardly through the perforated beam 12 and into the layer of fabric F wound thereon, and ascends under pressure toward the longitudinal opening 16 in the confining cylinder 15, as schematically illustrated in FIG. 2. The dye liquid, after soaking the fabric layer F to depth, is allowed to overflow through the opening 16 into the circulation chamber 17 and is collected at the bottom of the vessel 11, from which used dye liquid is withdrawn through a flow rectifier 46, conduit 36, heat exchanger 37 and conduit 40 back to the pump 38. The dye liquid is thus re-circulated through the dyeing system to repeat the operation.

From the foregoing it can be appreciated by the artisan that the invention provides a dyeing apparatus 10 having a cylindrical vessel 11 of generally circular transverse cross-section, and extending longitudinally along the generally horizontal axis. Although, as shown in FIG. 1, the vessel 11 has dished ends enclosing the volumetric regions $S_2$ $S_3$ such vessel can, and is for purposes of this application, considered cylindrical without regard to the shape of its ends, it being particularly notable that the central portion of the vessel 11, and the most part of its outer wall is cylindrical. Within the vessel 11 are means defining a perforated hollow beam 12 supported within such vessel 11 and extending longitudinally along the horizontal axis thereof. The beam 12 is capable to support material F to be dyed, which material F is wound upon the exterior of the beam 12 in the manner of a bobbin. The perforations of the beam allow dye liquid to flow into and through such material F.

To reduce the volume within the vessel 11 which must be supplied with dye liquid, an elongated dummy cylinder 28 is positioned within the hollow portion of the beam 12 to define therewith an annular flow passage for the dye liquid.

A non-perforated, elongated cylindrical shell 15 which is supported within the vessel 11 is interposed in laterally surrounding relation to the beam 12 and material F supported thereby. The shell 15 is spaced-apart in relation to the outer wall of the vessel 11 to define with said outer wall a first circumferential chamber 17. The shell 15 also defines a boundary of a second circumferential chamber 18, namely the treatment chamber 18, confining the dye liquid passed from the annular flow passage about dummy cylinder 28, through the perforations of the beam 12 and the material F. The shell 15 has at its upper portion an opening defined by confronting longitudinal edges 16, which opening permits overflow of dye liquid from the circumferential chamber 18 in the circumferential chamber 17.

As a practical expediency, the flared connector 34 and conduit 41 serve as means flow connected with the annular flow passage about dummy cylinder 28 to introduce into such flow passage dye liquid. Likewise, the conduit 36 serves as means flow connected with the circumferential chamber 17 for the outflow therefrom of the overflow dye liquid collected therein.

To reduce the structural loading upon the apparatus 10, as might result from pressure differentials between the hollow portion of dummy cylinder 28 and a given interior region of the vessel 11, the invention provides means establishing pressure equalizing communication between the hollow portion of the dummy cylinder 28 and such interior region of the vessel 11. This means is expediently in the form of a vent 43. Likewise, a vent 42 serves as means establishing pressure equalizing communication between the circumferential chamber 18 and the interior region $S_2$ of the vessel.

Having described the invention, it will be understood that the invention is not to limited to the precise form and construction herein advanced, but various modifications and changes may be made therein without departing from the scope of the appended claims.

I claim:

1. A dyeing apparatus which comprises a cylindrical vessel of generally circular cross-section extending longitudinally along a generally horizontal axis, said vessel having an outer wall; means defining a perforated hollow beam supported within said vessel and extending longitudinally along said axis; said beam being capable to support material to be dyed wound upon the exterior of the beam, the perforations of said beam allowing dye liquid to flow into and through such material; an elongated dummy cylinder positioned within the hollow portion of the beam to define therewith an annular flow passage for the dye liquid; a non-perforated elongated cylindrical shell supported within said vessel and interposed in laterally surrounding relation to said beam and material supported thereby, said shell being spaced-apart in relation to said outer wall of the vessel to define with said outer wall a first circumferential chamber, said shell defining a boundary of a second circumferential chamber confining dye liquid passed from said annular flow passage through the perforations of the beam and said material, said shell having at its upper portion an opening that permits overflow of dye liquid from said second circumferential chamber into said first circumferential chamber; means flow connected with said annular flow passage to introduce therein dye liquid; and means flow connected with said first circumferential chamber for the outflow therefrom of overflow dye liquid collected therein.

2. A dyeing apparatus according to claim 1 wherein said dummy cylinder is hollow and including means establishing pressure equalizing communication between the hollow portion of said dummy cylinder and a given interior region of said vessel.

3. A dyeing apparatus according to claim 2 wherein said means establishing pressure equalizing communication is a vent.

4. A dyeing apparatus according to claim 1 including partitions defining respective end boundaries of said second circumferential chamber; and means establishing pressure equalizing communication between said second circumferential chamber and a given interior region of said vessel.

5. A dyeing apparatus according to claim 4 wherein said means establishing pressure equalizing communication is a vent.

6. A dyeing apparatus according to claim 1 including a flared conduit communicating with said annular flow passage to supply dye liquid thereto.

* * * * *